US005297610A

United States Patent [19]

Noguchi et al.

[11] Patent Number: 5,297,610

[45] Date of Patent: Mar. 29, 1994

[54] PRESSURE CASTING METHOD AND APPARATUS

[75] Inventors: Keiichiro Noguchi, Higashihoirshima; Kouichi Hori, Kure; Masahiko Shibahara, Minami, all of Japan

[73] Assignee: Mazda Motor Corporation, Tokyo, Japan

[21] Appl. No.: 944,758

[22] Filed: Sep. 14, 1992

Related U.S. Application Data

[63] Continuation of Ser. No. 523,522, May 15, 1990, abandoned.

[30] Foreign Application Priority Data

May 16, 1989 [JP] Japan ..... 1-122216

[51] Int. Cl.[5] ..... B22D 18/00; B22D 27/13

[52] U.S. Cl. ..... 164/119; 164/34; 164/284

[58] Field of Search ..... 164/34, 35, 36, 119, 164/284, 66.1, 120

[56] References Cited

U.S. PATENT DOCUMENTS

| | | | |
|---|---|---|---|
| 3,635,791 | 1/1972 | Bly | 164/119 |
| 4,580,617 | 4/1986 | Blechner | 164/119 |
| 4,733,714 | 3/1988 | Smith | 164/119 |

FOREIGN PATENT DOCUMENTS

| | | | |
|---|---|---|---|
| 860846 | 1/1971 | Canada | 164/119 |
| 58-86968 | 5/1983 | Japan | 164/97 |
| 59-197370 | 11/1984 | Japan | 164/119 |
| 63-41352 | 3/1988 | Japan . | |
| 1-34571 | 2/1989 | Japan | 164/34 |

*Primary Examiner*—Paula A. Bradley
*Assistant Examiner*—Rex E. Pelto
*Attorney, Agent, or Firm*—Keck, Mahin & Cate

[57] ABSTRACT

A pressure molding method and apparatus uses a mold with a casting cavity and a pouring gate through which a molten metal is fed into the casting cavity. After feeding a molten metal into the mold through the pouring gate to fill the casting cavity and pouring gate, a cap member is placed on the mold to bring its open end into contact with a dead head of the molten metal in the pouring gate of the mold so as to form an air-tightly sealed chamber between the cap member and dead head of the molten metal. Pressure is supplied into the sealed chamber to force the molten metal in the mold through the dead head.

16 Claims, 3 Drawing Sheets

PRESSURE CASTING METHOD AND APPARATUS

This is a continuation of application Ser. No. 07/523,522, filed May 15, 1990 now abandoned.

BACKGROUND OF THE INVENTION

1. Field of the Invention

The present invention relates to a molding method and apparatus therefor, and more particularly to a method of pressure molding casting and an apparatus therefor in which sufficient force is applied to a molten material in a mold by a compressed gas to force the material into the mold.

2. Description of Related Art

In conventional pressure molding methods, a molten material is fed into a casting cavity of a mold made of particulate refractory through a pouring gate communicating the casting cavity to the exterior of the mold. Thereafter, a part surrounding the pouring gate of the mold is covered by a cover member formed with a peripheral flange to which a flexible sealing member is attached to form therein a pressure chamber in communication with a pressure source so as to conceal the pouring gate completely. Compressed air is then supplied into the pressure chamber of the cover member to force the molten material to stay in the pouring gate. A molding device embodying such a pressure molding method is known from, for example, Japanese Utility Model Application No. 61-131900 entitled "Full Mold Casting Device" filed on Aug. 28, 1986 and laid open as Japanese Unexamined Utility Model Publication No. 63-41352 on Mar. 18, 1988.

The molding device as described in the above publication deforms a flexible sealed member to conform to an opening of the pouring gate so as thereby to forcibly press the molten material in the pouring gate. The molding device, however, has a problem in that the flexible sealing member is damaged by heat transmitted thereto from the molten material. Accordingly, compressed air in the pressure chamber of the cover member escapes into the mold of particulate refractory. Thus, sure pressurization of the molten material in the pouring gate, and hence in the casting cavity of the mold, is not always provided. Accordingly, a product cast by such a molding device blow holes and/or has a structure with a non-uniform density.

SUMMARY OF THE INVENTION

It is, therefore, a primary object of the present invention to provide a pressure molding method and apparatus therefor which provides a completely sealed pressure chamber over the pouring gate of a mold.

It is another object of the present invention to provide a pressure molding method and apparatus therefor in which a molten material in a pouring gate of a mold, and hence in a cavity of the mold, is surely pressurized.

The objects of the present invention are achieved by a method and apparatus using a mold with a casting cavity and a pouring gate through which a molten metal is fed into the casting cavity. After feeding a molten metal into the mold through the pouring gate to fill the casting cavity and pouring gate, a cap member is placed on the mold to penetrate an open end thereof into a dead head of the molten metal in the pouring gate of the mold so as to form an air-tightly sealed chamber between the cap member and dead head of the molten metal. Pressure is supplied into the sealed chamber to force the molten metal in the mold through the dead head.

The mold is preferably made of particulate refractory consisting of non-coking, dry molding sand in which a substantially solid casting model made of an expanded plastic material is buried. The casting model is burnt up and caused to vanish by the molten metal fed into the mold to form a casting cavity in the mold.

For forming the air-tightly sealed chamber quickly without cooling the major part of the molten metal in the mold, it is desirable to form the pouring gate with a top flat surface with a groove which receives therein a molten metal forming part of the dead head of molten metal and the open end of the cap member.

DESCRIPTION OF THE DRAWINGS

The above and other objects and features of the present invention will be apparent from the following description of preferred embodiments thereof when considered in conjunction with the appended drawings, wherein like reference numbers have been used in different figures to denote the parts of the same or similar structure and operation and in which.

DETAILED DESCRIPTION OF THE PREFERRED EMBODIMENTS

Figure 1:
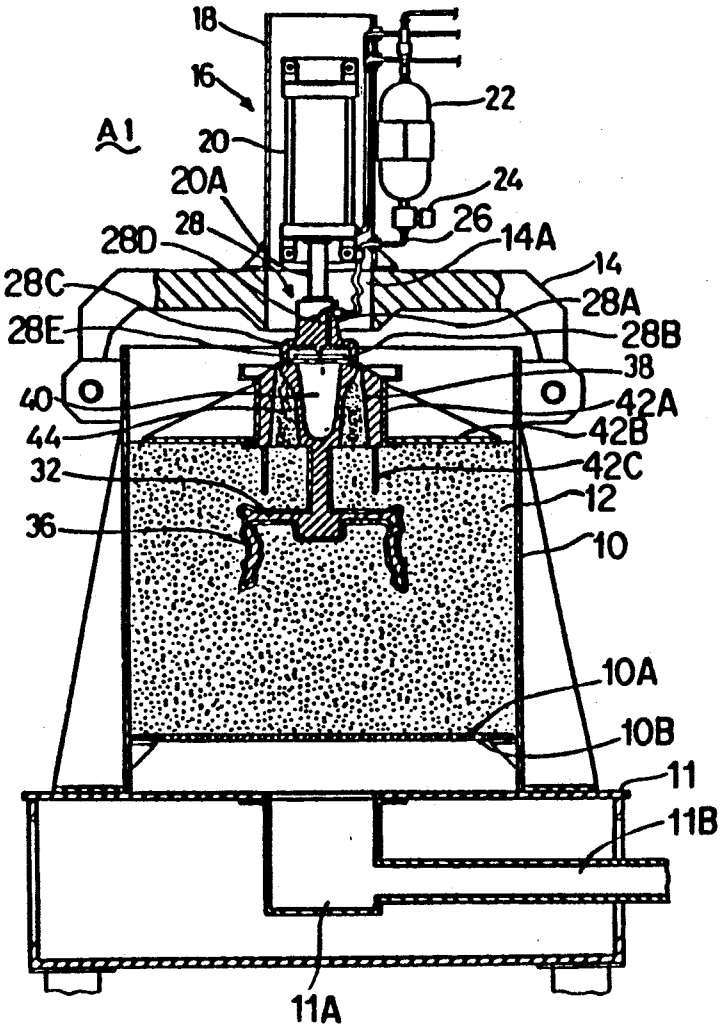
FIG. 1 is a cross-sectional view of a pressure molding apparatus in accordance with a preferred embodiment of the present invention in which a pressure is supplied in a sealed chamber.

Referring to the drawings, and in particular to FIG. 1, a pressure molding apparatus A1 according to a preferred embodiment of the present invention is shown in cross section as having a box-shaped molding box 10 with an open top. A bottom wall 10A of the molding box 10 is formed with a large number of air orifices 10B. The molding box 10 contains therein a mold 12 made of particulate refractory consisting of non-coking, dry molding sand. A top frame 14, having a generally U-shaped cross section, is detachably mounted on the top of the molding box 10. The top frame 14 is formed with a center hole 14A for receiving therein a press head 28 of a compression unit 16 which will be described in detail later.

A generally rectangular-box shaped base 11 on which the molding box 10 is placed is provided with a negative pressure chamber 11A connected to a pressure reducing pump (not shown) through an air passage 11B. The pressure reducing pump may be of any type well known in the art.

The compression unit 16, which is supported on the top frame 14, has an open ended cylindrical housing 18 with an air cylinder 20 and an accumulator 22 fixedly attached to its inner and outer walls, respectively. The air cylinder 20 and accumulator 22 are connected to a compressor (not shown) which may be of any type well known in the art. The air cylinder 20 has a linear piston rod 20A with its end attached to the press head 28.

The press head 28 comprises a solid cylindrical body 28A and a cylindrical cap 28B integrally formed with and extending as a flange from the solid cylindrical body 28A. The cap 28B extends downwardly from the solid cylindrical body 28A and forms therein an open space 28C. The solid cylindrical body is formed with an air passage 28D passing therethrough to communicate the open space 28C with the exterior of the press head 28. A flexible tube 26, connected to the air passage 28D of the cylindrical body 28A, connects the open space 28C to the accumulator 22. The cylindrical cap 28B is provided with an annular sealing member 28E detachably adhered to its under surface. The sealing member 28E is made of heat resistant cement.

Figure 2:
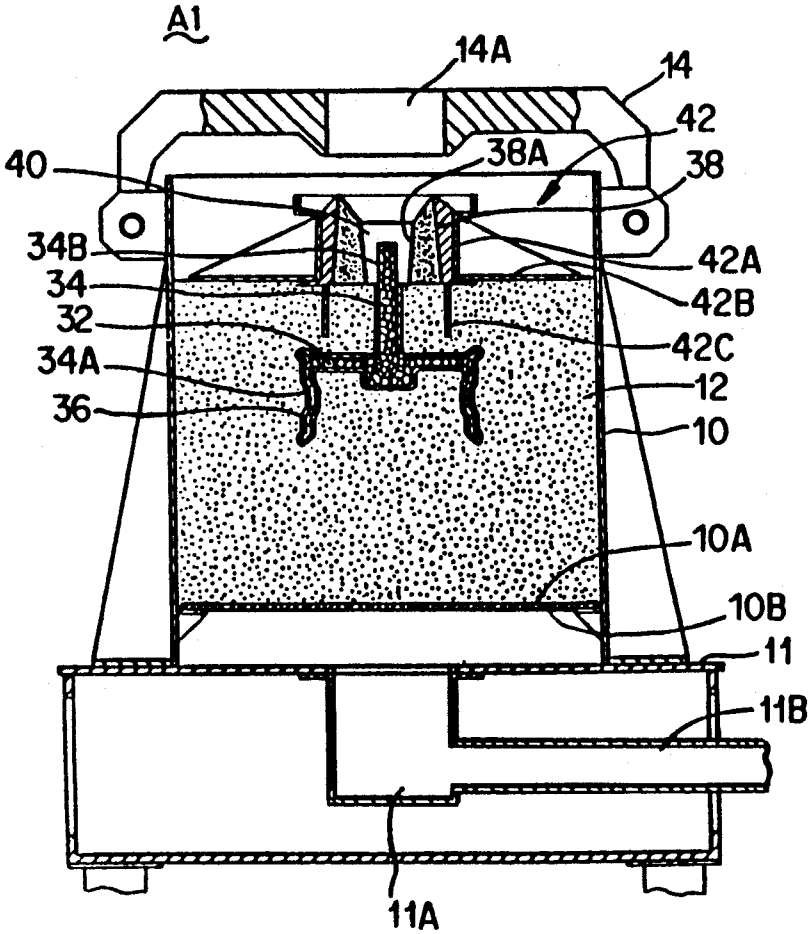
FIG. 2 is a cross-sectional view partly showing the pressure molding apparatus of FIG. 1 in a state before a molten metal is fed.

As is shown in more detail in FIG. 2, in the mold 12 of particulate refractory, a substantially solid casting model 34 is provided. The casting model comprises a model body portion 34A and a dead head portion 34B extending upwardly from the model body portion 34A. The casting model 34 is made of a material such as expanded polystyrene, which is burnable when subjected to heat so as to vanish or disappear. The casting model 34 is buried in with the dead head portion 34B projecting partially out of the uppermost surface of the mold 12. To bury the casting model 34 in the particulate refractory, the casting model 34 may be either inserted in particulate refractory as it flows into the molding box 10 while the inside of the box is decompressed by the pressure reducing device through the negative pressure chamber 11A and its air passage 11B. Alternatively, the casting model may be placed inside the molding box 10 before filling the molding box 10 with the particulate refractory. In any case, after burying the casting model 34 in the mold 12 of particulate refractory, it is desirable to vibrate the molding box 10, thereby tamping the particulate refractory so as to firmly form the mold 12 in the molding box 10. It is also desirable to apply a facing material to the outer surface of the casting model 34 before burying the casting model 34 in the particulate refractory.

After burying the casting model 34 in the particulate refractory and forming the mold 12, a cylindrical pouring gate 38 is provided by forming a wall of coking molding sand in a supporting sleeve 42. The supporting sleeve 42 has an upper cylindrical sleeve 42A with an annular flange 42B extending radially outwardly at the bottom thereof and a lower cylindrical sleeve 42C having a slightly smaller diameter than that of the upper cylindrical sleeve 42A. The lower cylindrical sleeve 42C is fully inserted in the mold 12 until the annular flange 42B is brought into contact with the uppermost surface of the mold 12. The wall forming the pouring gate 38 is placed within and supported by the supporting sleeve 42 on the uppermost surface of the mold 12 so as to surround part of the dead head portion 34B of the casting model 34 extending out of the mold 12 leaving an appropriate radial clearance. The pouring gate 38 has a tapered hole 38A with its top end beveled. The beveled top end of the tapered hole 38A is rounded to have an inner diameter slightly larger than an outer diameter of the cylindrical cap 28B of the press head 28 of the compression unit 16.

In making a casting by the use of the pressure molding apparatus A1 depicted in FIGS. 1 and 2, after forming the mold 12 having the pouring gate 38 with a casting model 34 buried in the particulate refractory in the molding box 10, a molten metal 44, such as a molten aluminum, is fed into the pouring gate 38. The molten metal 44 enters into the mold 12, burning out the casting model 34, thereby forming a casting cavity 36 with the facing material left on the inner surface of the casting cavity 36 in the mold 12. Gases, which are generated and trapped in the mold 12 when the casting model 34 burns, are relieved through the negative pressure chamber 11A and air passage 11B connected to the pressure reducing device via the air orifices 10B in the bottom wall 10A of the molding box 10.

Immediately after feeding a sufficient volume of the molten metal 44 to fill up the casting cavity 36 and the dead head portion of the mold 12, and desirably within approximately 10 seconds after such feeding of the molten metal 44, the air cylinder 20 is actuated to extend or protrude the piston rod 20A so as to cause the open end of the cylindrical cap 28B of the press head 28 connected to the piston rod 20A to penetrate into the molten metal 44 stuck to the inner surface of the pouring gate 38. As a result of penetration of the cylindrical cap 28B of the press head 28 into the metal 44, the cylindrical cap 28B of the press head 28 absorbs heat from the molten metal 44 in the pouring gate 38, thereby quickly cooling the molten metal 44 in the pouring gate 38. The molten metal 44 in the pouring gate 38 is therefore solidified so as to firmly grasp the sealing member 28E of the cylindrical cap 28B. In a short period of time, for example, approximately seven seconds, after penetration of the cylindrical cap 28B into the molten metal 44 in the pouring gate 38, an air-tight, sealed space or chamber 40 is completed between the cylindrical cap 28B and the outer surface of the molten metal 44 in the pouring gate 38.

A space 28C formed within the cylindrical cap 28B is supplied with a compressed gas, such as compressed air, maintained at, for example, four atmospheres from the accumulator 22. The space 28C is pressurized for approximately 20 seconds after the initiation of compressed gas supply. Accordingly, the air-tight sealed space 40 is pressurized, forcibly pressing the dead head of the molten metal 44 and hence the molten metal 44 into the casting cavity 36 and providing a casting having the same shape as the casting model 34 without blow holes and pin holes.

After relieving the pressurized air in the space 28C, the air cylinder 20 is actuated to retract the piston rod 20A so as to lift up the press head 28, leaving the sealing member 28E of the cylinder cap 28B in the solidified metal 44 in the pouring gate 38. Finally, the mold 12 of particulate refractory is broken to take out the casting.

Figure 3:
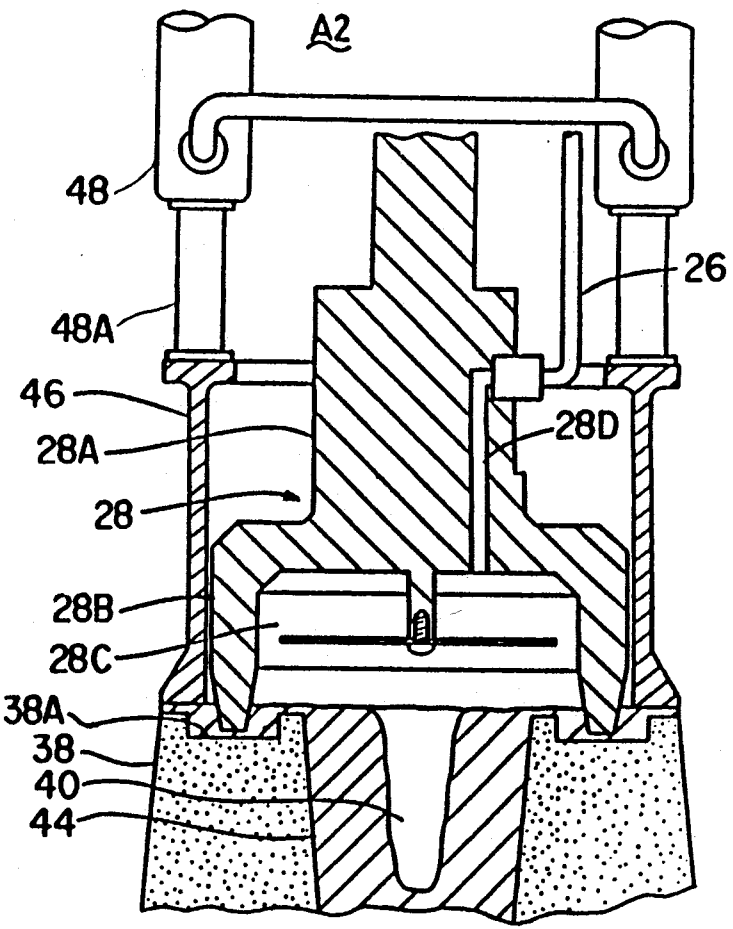
FIG. 3 is a cross-sectional view of a pressure molding apparatus in accordance with another preferred embodiment of the present invention in which a cap member has been moved down to form a sealed chamber.
Figure 4:
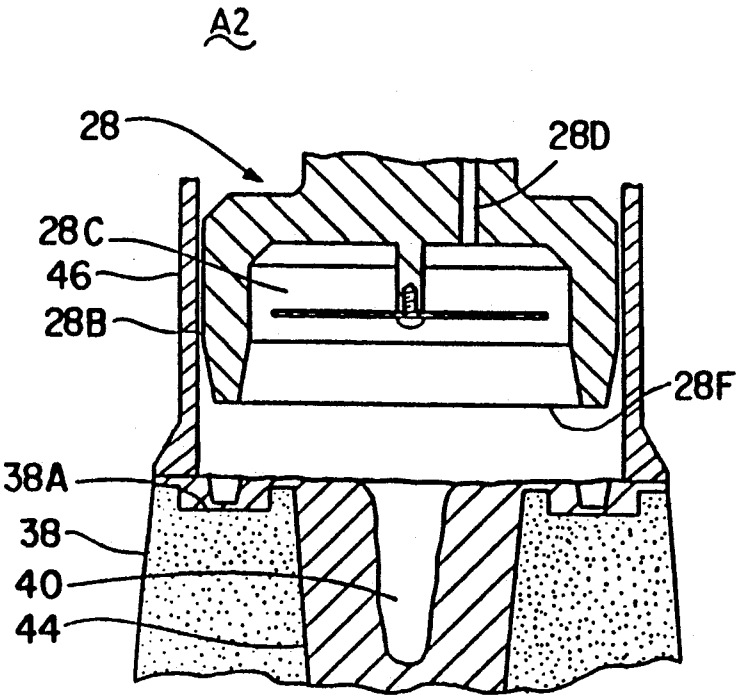
FIG. 4 is a cross-sectional view partly showing the pressure molding apparatus of FIG. 3 in which a cap member is in an upper position.

Referring to FIGS. 3 and 4, shown is a pressure molding apparatus A2 according to another preferred embodiment of the invention. In this embodiment, a member similar to the sealing member 28E attached to the cylindrical cap 28B of the press head 28 in the previously described embodiment is not used. Also, the cylindrical pouring gate 38 provided by forming a wall of cocking molding sand in the supporting sleeve 42 (not shown in FIGS. 3 and 4) is formed with an annular groove 38A which has a substantial rectangular cross-section and a depth of approximately 5 mm. in the uppermost flat surface of the gate.

The cylindrical cap 28B of the press head 28 has a flat under surface 28F. Surrounding the press head 28, the compression unit 16 is further provided with an open ended outer cylindrical barrel 46 with an enlarged under flat surface supported by a pair of air cylinders 48 at its upper end. Each air cylinder 48 works to move vertically up and down the outer cylindrical barrel 46 relative to the upper surface of the pouring gate 38.

In the pressure molding apparatus A2, the molten metal 44 is fed into the casting cavity 36 through the pouring gate 38 and the annular groove 38A of the pouring gate 38. The molten metal 44 in the annular groove 38A in the upper surface of the pouring gate 38 can be cooled relatively quickly by the cylindrical cap 28B of the press head 28 because the volume of the groove 38A is small as compared to that of the pouring gate. When the molten metal 44 reaches a temperature range of plus or minus 50° C. relative to a solidification temperature thereof, (i.e., approximately 500°-550° C.), the air cylinders 48 are actuated to move the cylindrical cap 28B downwardly and press it against the solidified metal 44 in the annular groove 38A. Because, in this temperature range, the metal 44 in the annular groove 38A is still deformable even though it has solidified, the open end of the cylinder cap 28B penetrates into the metal 44 in the annular groove 38A without sticking to the solidified metal 44, so as to provided a completely air-tightly sealed space or chamber 40 formed within the cylindrical cap 28B.

In the same manner as described for the previous embodiment, the open space 28C of the cylindrical cap 28 is supplied with pressurized gas maintained at, for example, four atmospheres. Such pressurized gas is supplied from the accumulator 22. Pressure is maintained for approximately 20 seconds after the initiation of pressurized gas supply. Accordingly, the air-tightly sealed space 40 is pressurized to forcibly press the dead head portion of the molten metal 44 into the pouring gate 38, and hence the molten metal 44 in the casting cavity 36 sufficiently so as to provide a casting without blow holes and pin holes.

After relieving the pressurized gas in the air-tightly sealed chamber 40, the air cylinder 20 is actuated to retract the piston rod 20A while pressure applied by the air cylinders 48 is maintained to continuously press the outer cylindrical barrel 46 against the outer marginal portion of the solidified metal 44 in the annular groove 38A, thereby smoothly separating the cylindrical cap 28B of the press head 28 from the solidified metal 44 in the pouring gate 38 and lifting it up. Finally, the mold 12 of particulate refractory is broken to take out the casting. Because no solidified metal 44 sticks to the outer surface of the open end of the cylindrical cap 28B, the cylindrical cap 28B is reusable for another molding process.

The cylindrical cap 28B of the press head 28 in this embodiment, for easy separation from the solidified metal 44 in the annular groove 38A, preferably has lower inner and outer surfaces inclined more than 10 degrees with respect to a vertical axis along which the press head 28 moves. Easy separation of the cylindrical cap 28B from the solidified metal 44 is achieved by the following structural and functional features:

(1) The annular groove 38A of the pouring gate 38 is formed so as to have a depth of approximately 5 mm;

(2) The penetration of the cylindrical cap 28B into the metal 44 in the annular groove 38A is performed immediately after solidification of the molten metal 44; and (3) The cylindrical cap 28B is lifted up while the marginal portion of the solidified metal 44 in the annular groove 38A is pressed down by the outer cylindrical barrel 46.

Although the above features (1) to (3) are all preferably realized in the pressure molding apparatus, it is sufficient if at least one of the features therein is used.

Figure 5:
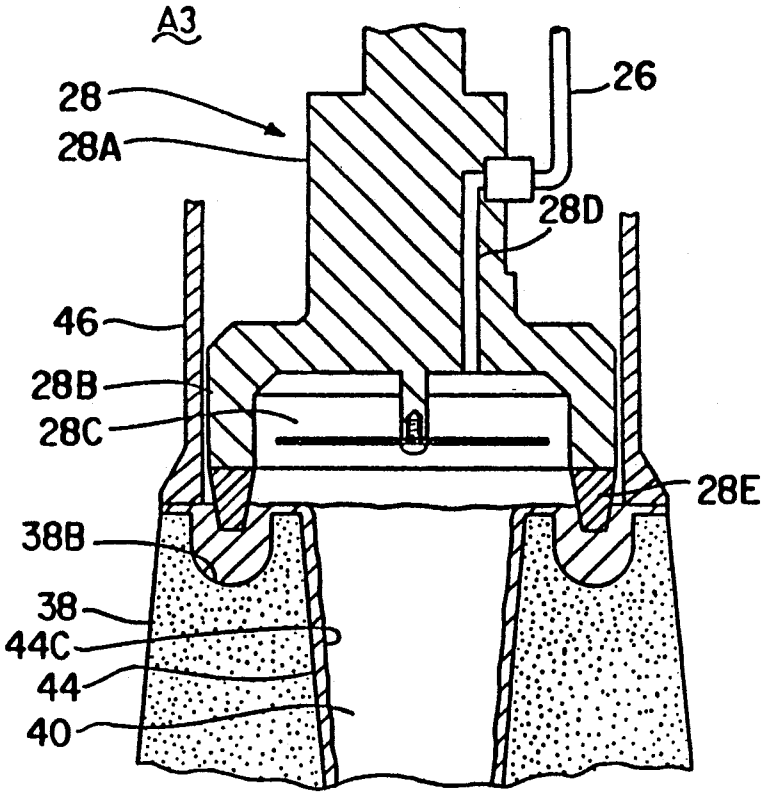
FIG. 5 is a cross-sectional view partly showing a pressure molding apparatus in accordance with still another preferred embodiment of the present invention in which a cap member has been moved down to form a sealed chamber.

Referring to FIG. 5, which shows a variant of the pressure molding apparatus A2 shown in FIGS. 3 and 4, a pressure molding apparatus A3 is characterized in that the cylindrical pouring gate 38 is formed with an annular groove 38B which has a substantially semi-circular cross section and a depth considerably deeper than the annular groove 38A of the pressure molding apparatus A2 shown in FIGS. 3 and 4.

Because the annular groove 38B has a relatively large volume as compared to the annular groove 38A of the previous embodiment, the molten metal 44 in the annular groove 38B is cooled more slowly than the molten metal in the annular groove 38A. When the cylindrical cap 28B of the press head 28 is moved down under the same conditions as in the previous embodiment, the metal 44 is still half-solidified, allowing the open end of the cylindrical cap 28B to penetrate into the half-solidified metal 44 in the annular groove 38B of the pouring gate 38.

In a pressure molding apparatus shown in either FIGS. 3 and 4 or FIG. 5, the cylindrical cap 28A or 28B is prevented from directly contacting with the molten metal 44 in the pouring gate 38. Therefore, a very small or nonexistent drop in temperature of the dead head of molten metal 44 is provided, so as to improve the efficiency with which molten metal is charged into the casting cavity 32. On the other hand, heat is prevented from being transmitted from the large volume of molten metal 44 in the mold 12, which is at a high temperature, to the compression unit 16 through the press head 28, so that the air cylinder 20 and its associated elements are not damaged.

If desirable, the sealing member 28E, made of a heat resistant cement, may be omitted. In this case, the press head 28 can be wholly and integrally made of metal. Such a whole metallic press head contributes to quicker solidification of the molten metal 44 in the annular groove 38B, so that compressed gas can be supplied quickly into the sealed space or chamber 40 under the press head 28.

Figure 6:
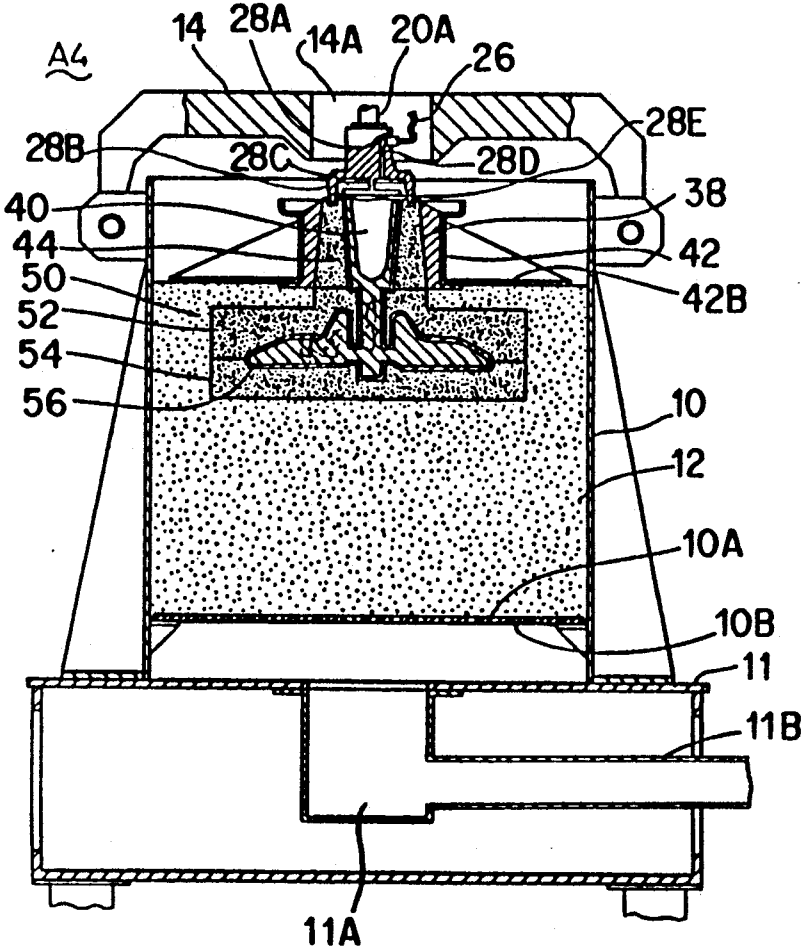
FIG. 6 is a cross-sectional view partly showing a pressure molding apparatus in accordance with a further preferred embodiment of the present invention in which a cap member has been moved down to form a sealed chamber.

Referring to FIG. 6, showing a pressure molding apparatus A4 according to a still another preferred embodiment of the invention, a sand mold is buried in the mold of refractory material in place of the casting model 36 used in the pressure molding apparatus A1 of the first embodiment of the present invention shown in FIGS. 1 and 2. That is, a sand mold 50, comprising an upper mold cover 52 and a lower mold base 54, both of which are made of coking molding sand, are separately provided. After applying a facing material 56 onto inner surfaces of casting cavities of the upper cover and lower base 52 and 54, respectively, the sand mold 50 is assembled by coupling the upper and lower molds 52 and 54 together. This sand mold 50 is buried in the particulate refractory 12 in the molding box 10 of the pressure molding apparatus A4 in the same manner as the casting model 36 was described as being buried in the first embodiment shown in FIGS. 1 and 2.

Although each pressure molding apparatus in the embodiments described above is used with a mold which includes a burnable casting model providing a casting cavity when burned up, the pressure molding apparatus can cooperate with any type of mold, such as not only sand molds but also metalic molds including a sand core or a shell core.

It is to be understood that although the invention has been described in detail with respect to preferred embodiments, nevertheless, various other embodiments and variants are possible which are within the spirit and scope of the invention, and such embodiments and variants are intended to be covered by the following claims.

What is claimed is:

1. A pressure casting method using a mold with a casting cavity and a pouring gate through which a molten metal is fed into said casting cavity, said pressure molding method comprising the steps of:

feeding a molten metal into said mold through said pouring gate to fill said casting cavity and pouring gate with said molten metal;

forming a dead head of the molten metal so that it surrounds a top of said pouring gate;

placing a cap member on said mold to bring an under surface extending entirely around an open end of said cap member into direct contact with said dead head of said molten metal at the top of said pouring gate;

forming an air-tightly sealed chamber between said cap member and said dead head of the molten metal by pushing said cap member into said dead head and casing the cap member to penetrate into the molten metal; and supplying pressure into said air-tightly sealed chamber to force said molten metal in said mold through said dead head.

2. A pressure casting method as defined in claim 1, wherein said mold is made of particulate refractory.

3. A pressure casting method as defined in claim 1, wherein said mold is made of particulate refractory consisting essentially of dry molding sand.

4. A pressure casting method as defined in claim 1, wherein said mold is made of particulate refractory consisting essentially of non-coking, dry molding sand.

5. A pressure casting method as defined in claim 1, wherein said pressure is supplied in a form of compressed gas.

6. A pressure casting method as defined in claim 5, wherein said compressed gas is air.

7. A pressure casting method as defined in claim 1, wherein said casting cavity is formed by burying, in a particulate refractory, a substantially solid casting model which is burnt up and caused to vanish by heat.

8. A pressure casting method as defined in claim 7, wherein said substantially solid casting model is made of an expanded plastic material.

9. A pressure casting method as defined in claim 8, wherein said substantially solid casting model is made of an expanded polystyrene.

10. A pressure casting method using a mold with a casting cavity and a pouring gate through which a molten metal is fed into said casting cavity, said pressure molding method comprising the steps of:

feeding a molten metal into said mold through said pouring gate to fill said casting cavity and pouring gate with said molten metal;

placing a cap member on said mold to bring an open end of said cap member into contact with a dead head of said molten metal in said pouring gate of said mold and form an air-tightly sealed chamber between said cap member and said dead head of said molten metal, said pouring gate being formed with a flat top surface having a groove which receives molten metal forming part of said dead head and said open end of said cap member to form said air-tightly sealed chamber between said cap member and said dead head of said molten metal; and supplying pressure into said air-tightly sealed chamber to force said molten metal in said mold through said dead head.

11. A pressure casting method as defined in claim 10, wherein said cap member is placed on said mold to put said open end of said cap member in said groove when said molten metal in said groove is approximately half solidified.

12. A pressure casting method as defined in claim 10, wherein said cap member is placed on said mold to put said open end of said cap member in said groove while said molten metal in said groove is deformable as a whole with its outer surface solidified.

13. A pressure molding apparatus for molding molten metal in a mold, said pressure molding apparatus comprising:

a mold formed with a casting cavity having a pouring gate;

means for feeding molten metal into said mold through said pouring gate and forming a dead head of molten metal so that it surrounds a top of said pouring gate;

a cap member having an under surface extending entirely around an open end which is removably brought into direct contact with said dead head of molten metal; and means for pushing said cap member into said dead head so as to cause the cap member to penetrate into the molten metal and form an air-tightly sealed chamber between said cap member and said pouring gate; and a compressed gas source for supplying a compressed gas into said air-tightly sealed chamber.

14. A pressure molding apparatus as define in claim 13, wherein said mold is made of a particulate refractory a burnable, substantially solid casting model buried in said particulate refractory.

15. A pressure molding apparatus as define in claim 13, wherein said cap member has a sealing member detachably fixed to said open end.

16. A pressure molding apparatus as define in claim 15, wherein said sealing member is made of heat resistant cement.

* * * * *